US005169304A

United States Patent [19]

Flament et al.

[11] Patent Number: 5,169,304

[45] Date of Patent: Dec. 8, 1992

[54] INDUSTRIAL LIQUID FUEL BURNER WITH LOW NITROGEN OXIDE EMISSION, SAID BURNER GENERATING SEVERAL ELEMENTARY FLAMES AND USE THEREOF

[75] Inventors: Patrick Flament, Rueil Malmaison; Frédéric Bury, Allauch; Gerard Martin, Rueil Malmaison; Jean-Claude Pillard, Marseille, all of France

[73] Assignees: Institut Francais du Petrole, Rueil Malmaison; Enterprise Generale de Chauffage Industriel Pillard, Marseille Cedex, both of France

[21] Appl. No.: 635,248

[22] Filed: Dec. 28, 1990

[30] Foreign Application Priority Data

Dec. 28, 1989 [FR] France ..... 89 17346

[51] Int. Cl.[5] ..... F23M 9/00

[52] U.S. Cl. ..... 431/183; 431/187

[58] Field of Search ..... 431/8, 9, 10, 187, 183, 431/142, 181

[56] References Cited

U.S. PATENT DOCUMENTS

| | | | |
|---|---|---|---|
| 3,775,038 | 11/1973 | Pillard | 431/181 |
| 3,775,039 | 11/1973 | Pillard | 431/183 |
| 4,604,048 | 8/1986 | Schwartz et al. | 431/187 |
| 4,842,509 | 6/1989 | Hasenack | 431/9 |
| 4,925,387 | 5/1990 | Locanetto et al. | 431/187 |

*Primary Examiner*—James C. Yeung

*Attorney, Agent, or Firm*—Antonelli, Terry, Stout & Kraus

[57] ABSTRACT

A parallel flow liquid fuel burner is disclosed which has a device for injecting fuel in a central flame stabilizer; the stabilizer comprises a blade-containing rose situated around a central hub itself situated around the injection device and the injection device comprises several fuel injection orifices adapted to provide separate elementary flames.

10 Claims, 2 Drawing Sheets

INDUSTRIAL LIQUID FUEL BURNER WITH LOW NITROGEN OXIDE EMISSION, SAID BURNER GENERATING SEVERAL ELEMENTARY FLAMES AND USE THEREOF

BACKGROUND OF THE INVENTION

1. Field of the Invention

The present invention relates to a parallel flow liquid fuel burner for cooled or hot wall boilers and furnaces.

Industrial cooled (or hot wall) boilers and furnaces correspond as a whole substantially to two essential types of technology:

turbulence (or turbulence sliding valve) burners, parallel flow burners.

The present invention relates to latter type of burner, which comprises means for providing an air flow parallel to the axis of a cylindrical or conical body, and a flame retention baffle, generally formed of a slanted blade rose for giving a rotational movement to a part of the supply air, which takes up a part of the outlet section of the cylindrical or conical body.

2. Description of the Prior Art

The prior art may be illustrated by the French patent FR 2 No. 122,820 in the name of the firm Pillard and the French patent FR No. 2 564 182 in the name of the Institut Francais du Pétrole.

The need to reduce the nitrogen oxides (NOx) generated in flames has for a long time shown the advantage of reducing the free oxygen content ($O_2$) which combines with the nitrogen of the fuel, to step the combustion so as to reduce the peak temperatures, and increase the rate of burnt gases recycled into the flame for the same purpose.

SUMMARY OF THE INVENTION

The present invention provides a device which makes it possible to substantially reduce the nitrogen oxides while keeping good quality combustion. In addition, the device according to the present invention is easy to implement.

The basic idea of the present invention resides in the combination of the following characteristics:

a parallel flow burner comprising a flame stabilizer with single inclined blade containing rose, a parallel flow burner whose inclined blade containing rose has a central hub or disk or cone of a relative dimension sufficient in diameter, and an auxiliary fluid spray injector having several output orifices but in a number n sufficiently small relatively to the angle of the cone on which the axes of the injection orifices are situated so that the burner generates n separate flames over its operating range or over the whole operating range (up to nominal working).

As above stated, such a combination enables a liquid fuel injector to create several independent flames which provide stepped combustion because an amount of air penetrates further into the combustion zone before reaching the fuel. This amount of air corresponds to that which is passed through adjacent fuel jets.

This combination also limits the peak temperature of the different flames through a high rate of recirculation of gases resulting from combustion in the different flames, while maintaining a stabilized flame and avoiding deposit of unburnt fuel droplets on the stabilizer.

All other things being equal, the burner of the present invention reduces by about 30% or more the NO emissions of the flame.

More generally, the present invention concerns a parallel flow liquid fuel burner having means for injecting fuel and a central flame stabilizer. This burner is characterized in that in combination:

said stabilizer comprises a blade containing rose situated about a central hub itself situated an about injection means, and said injection means comprise several fuel injection orifices adapted to form separate elementary flames.

The flame stabilizer may be cylindrical and occupy a part of the outlet section of the burner, the hub may be in the form of a disk or a cone whose output plane is situated in the output plane of the blades or set back therefrom and whose diameter may be greater than or equal to 35% of the diameter of the stabilizer and, finally, the injection means may be of auxiliary fluid spray type.

The diameter of the hub relative to the diameter of the stabilizer may be greater than 45% and preferably between 45 and 60%.

The fuel injection means may be adapted to create a number of elementary flames at most equal to 6. Similarly, the injection means may be adapted to generate a number of elementary flames greater than or equal to 4.

The injection means may comprise several injection orifices whose axes may be distributed over at least a conical surface the angle at the apex of which may be between 70° and 110°.

The injection means may comprise several orifices whose axes may be distributed over two coaxial conical surfaces having different angles at the apices, and the orifices may be angularly offset.

The auxiliary fluid may be steam or a compressed gas forming a mixture or an emulsion between the auxiliary fluid and the fuel.

The hub may comprise a disk shaped portion with radial slits fed with oxidizer air, these slits delivering an oxidizer air jet substantially parallel to the surface of the disk.

The fluid, which may be multiphase such as an emulsion leaving the injection means may have an average speed between 40 and 100 m/s.

The burner according to the present invention may be used in .an industrial application, particularly for powers between 3 and 75 MW per burner.

BRIEF DESCRIPTION OF THE DRAWINGS

The present invention will be better understood and its advantages will be clear from the following description of particular examples, which are non limiting and which are illustrated by the accompanying figures in which.

DESCRIPTION OF THE PREFERRED EMBODIMENTS

Figure 1:
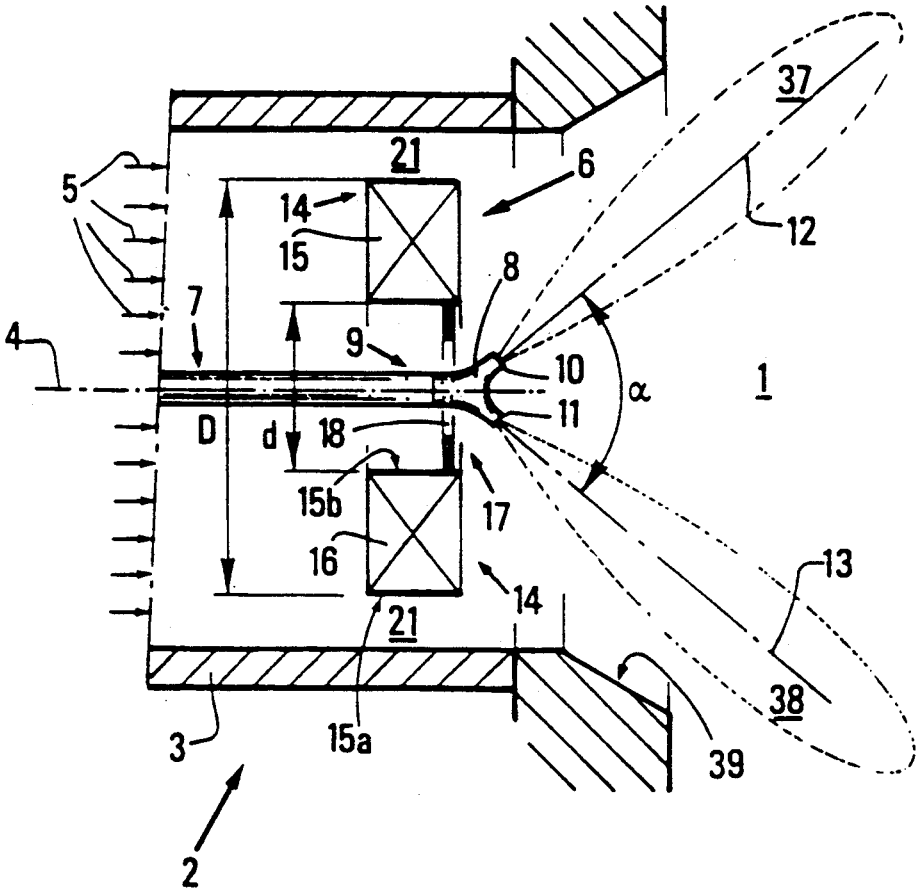
FIG. 1 illustrates schematically, in section, one embodiment of a burner according to the invention.

In FIG. 1 reference numeral 1 designates a furnace fed by a burner 2 of the parallel flow type comprising a cylinder 3 which may be eventually replaced by a cone. This cylinder 3 with axis 4 is conventionally fed with air. The general direction of the air is substantially axial and is shown by arrows 5.

Reference numeral 6 designates the stabilizer as a whole which is substantially centered about the end of the liquid fuel injection pipe 7. The axis of the injection pipe merges with the axis 4 of cylinder 3. The fuel injection pipe may be preferably of the spray type using an auxiliary fluid, such as steam, compressed air, or a compressed gas.

The auxiliary fluid provides spraying or atomization of the liquid fuel, which is mixed and may form an emulsion therewith.

To improve the injection and provide ultra-fine fuel atomization, the system disclosed in the French patent application (EN. 88/17591) in the name of the firm Pillard may be used. This system provides a double atomization which avoids formation of large diameter droplets generally formed in contact of the liquid film with the solid walls, such as those of the outlet orifice.

The injection pipe 7 comprises at the end portion 8 of end 9 several orifices 10, 11 for introducing the auxiliary fluid/fuel mixture into furnace 1.

The injection orifices have injection axes 12, 13. Preferably, in accordance with the present invention, the axes of the injection orifices are situated on a conical surface with an angle at the apex $\alpha$ (alpha) between 60° and 110°.

The stabilizer 6 comprises a rose 14 with blades 15, 16 slanted with respect to the axial plane. These blades which surround the central hub 17 may be flat or curvilinear.

The stabilizer further comprises an outer cylinder 15*a* and an inner cylinder 15*b*.

Hub 17 has a central opening 18 for passing the injection pipe 7, therethrough.

In FIG. 1, hub 17 is in the form of a disk having radial slits. The hub may be manufactured by forging or stamping. The radial slits 19 (FIG. 3) are fed with oxidizer air and allow the surface of the hub to be cooled and swept so as to avoid deposits thereon. The air leaves the slits substantially tangentially to the surface of the disk.

In FIG. 1, blades 15, 16 have a leading edge comprised in a radial plane.

The hub 17 shown in FIG. 1 is set back from the radial plane comprising the leading edge of blades 15, 16.

In FIG. 1, the numeral 39 designates an opening which may be conical (in case of the FIG. 1) or cylindrical.

Figure 2:
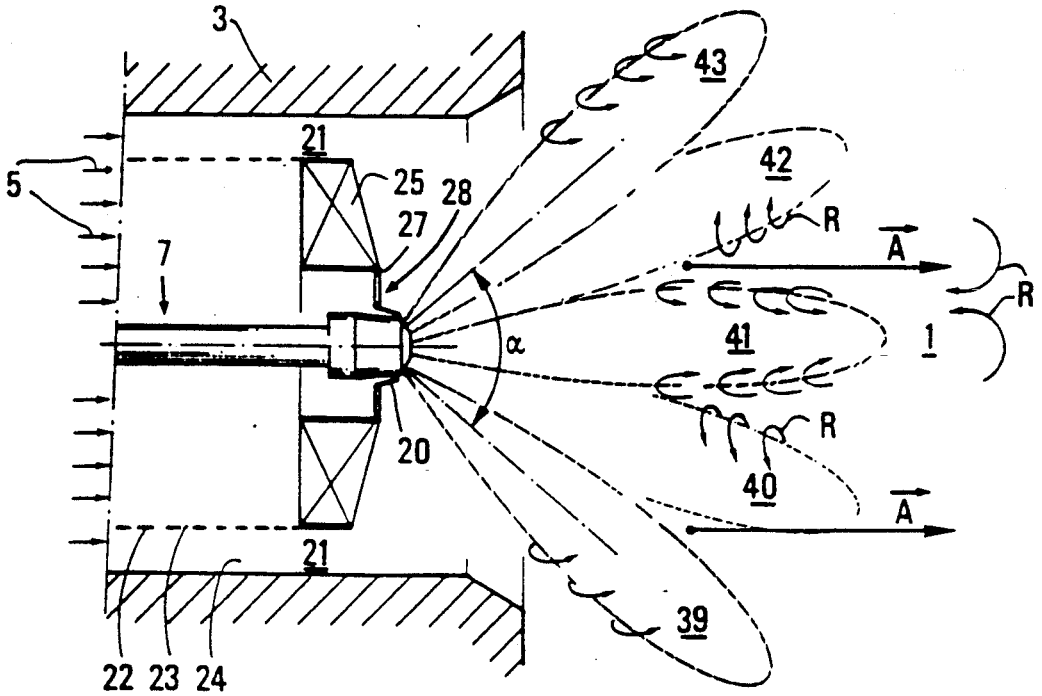
FIG. 2 shows a second embodiment of a burner according to the invention, comprising a hub with a truncated cone shaped portion.

Without departing from the scope of the present invention, the central hub may have a planar shape or may comprise a conically shaped part 20 (FIG. 2).

It can be seen in FIG. 1 that the stabilizer occupies only a part of the flow section provided for air 5 by cylinder 3. A free annular space 21 is provided around the stabilizer 6, this space being used for the flow of a portion of the oxidizer air. The cross section of this annular space may be equal to or greater than 10% of the total flow section of cylinder 3 and may be preferably between 10 and 50%. Good results may be obtained for flow sections of the annular space between 10 and 35% of the total flow section of the passage of cylinder 3 and particularly for a value close to 25%.

In accordance with FIG. 2, which illustrates another embodiment of the burner shown in FIG. 1, the air feeding the stabilizer is guided upstream thereof by a skirt 22, which may be formed with passages 23.

The elements which are common or similar on the different figures have the same references.

In FIG. 2, the space 21 between stabilizer 6 and zone 3 is fed by the annular cylinder 24 defined by the cylindrical skirt 22 and cylinder 3.

Figure 3:
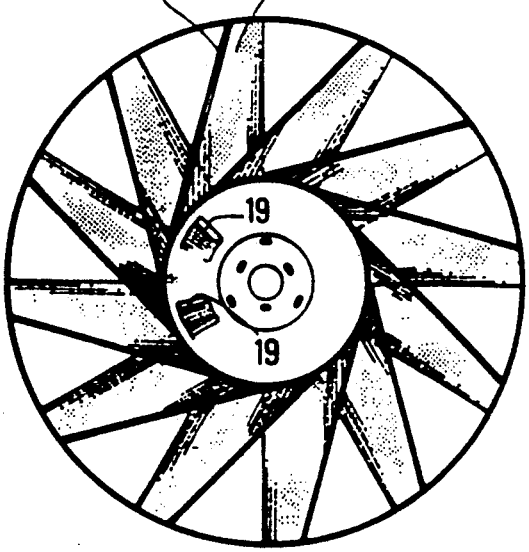
FIG. 3 shows the stabilizer of the embodiment of FIG. 2, seen from the front.

The blades 25 shown in FIGS. 2 and 3 have a leading edge 26 which is slanted rearwards with respect to a radial plane and slanted with respect to an axial plane.

When the blades of the rose of the stabilizer have a rearward slanting leading edge, the central hub or the disk may be set back with respect to the radial plane comprising the most advanced point of the leading edge oriented towards furnace 1. In FIG. 2, this point bears the reference 27.

In FIG. 2, the disk of hub 28 is situated in the radial plane, including this point 27.

Figure 4:
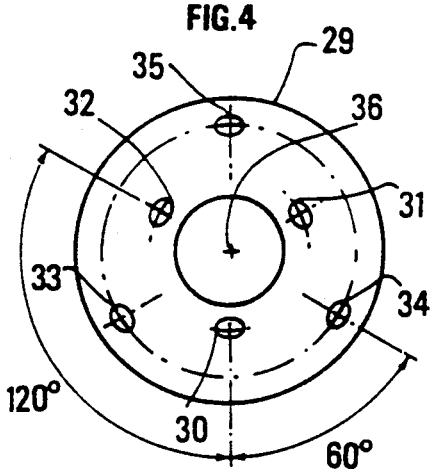
FIG. 4 shows a method of distributing the fuel injection orifices on the fuel injection means.

FIG. 4 shows the end portion 29 of an injection pipe seen from the front. This end portion has six injection orifices: three of which referenced 30, 31, 32 have injection axes distributed over a conical surface forming an angle at the apex of 70°, and three others 33, 34, 35 surrounding the preceding ones, have injection axes distributed over a conical surface with an angle at the apex of 110°.

Orifices 30, 31, 32 are angularly offset with respect to orifices 33, 34 and 35.

In FIG. 4, the orifices the axes of which are placed on the same cone are successively spaced apart by 120°. The angular spacing between the successive orifices which may be on one cone or on the other, is 60°.

Such angular spacings are considered by rotating a plane on the axis 36 of the injection pipe. Such an arrangement promotes separation of the elementary flames.

The end portion 29 of the injection pipe may have a truncated shape (case of FIG. 2) or a partially spherical shape.

In FIG. 1, the diameter of the stabilizer is designated by the letter D and the diameter of the central hub by the letter d.

According to the present invention:

d/D is preferably greater than 35% d/D may be between 45% and 60%.

In FIG. 1, two elementary flames 37 and 38 have been shown schematically and in FIG. 2, five elementary flames 39, 40, 41, 42 and 43 have been shown schematically.

According to the present invention, the "flame" generated by the burner is a multi-flame formed of several elementary independent separated flames 37, 38 (FIG. 1) or 39 to 43 (FIG. 2), each having a small diameter, the said flames being not grouped together in a single large sized flame.

Between the elementary flames 39 to 43 which do not touch each other, there flows a portion of the oxidizer air A which participates then in the flame end combustion. Therefore, the separation of distinct elementarly flames makes it actually possible to obtain stepped combustion due to the stepping of the air, a portion of the air avoiding the fuel at the outset. Reciprocally, the elementary flames are slightly oxydenated at the outlet.

The slanted blade containing rose is designed to provide a high rate of recirculation "R" of the gases towards the elementary flames. Since each flame is of small size, lacking air at the outset with high axial recirculation, it is then at a limited peak temperature.

The presence of hub 28 (disk, cone) allows a flame stabilization "pilot" vortex to be formed and ignited, which prevents blow-off of the elementary flames and ensures stabilization thereof.

What is claimed is

1. A parallel flow liquid fuel burner comprising injection means for injecting a fuel into a combustion zone of a furnace, said injection means including an injection pipe extending along a longitudinal axis of said burner and a central flame stabilizer surrounding said injection pipe; said stabilizer comprising a blade-containing rose situated around a central hub, said hub being positioned around the injection pipe of said injection means and comprising a disk-shaped portion, said disk-shaped portion having radial slits fed with combustive air, each of said slits delivering a combustive air jet substantially parallel to a surface of the disk; and said injection means further comprising several fuel injection orifices at an end of said injection pipe, said orifices being adapted to form separated elementary flames.

2. A burner as claimed in claim 1, wherein the flame stabilizer is cylindrical and occupies a portion of the outlet section of the burner, said hub has an output plane situated in an output plane of the blades or set back therefrom, the diameter of the hub being greater than or equal to 35% of the diameter of the stabilizer and said injection means comprise an auxiliary fluid spray type injector.

3. The burner as claimed in claim 2, wherein the diameter of the hub related to the diameter of the stabilizer is between 45 and 60%.

4. The burner as claimed in any one of claims 1 to 3, wherein said fuel injection means is adapted to create a number of elementary flames at most equal to 6.

5. The burner as claimed in claim 1, wherein said injection means comprises several injection orifices, the axes of which are distributed over at least a conical surface, the angle at an apex of the conical surface being between 60° and 110°.

6. The burner as claimed in claim 1, wherein said injection means comprises several orifices, the axes of which are distributed over two coaxial conical surfaces with distinct angles at the apices and said orifices being offset angularly.

7. The burner as claimed in any one of claims 1, 2 and 3, wherein an auxiliary fuel feed to the burner is steam or a compressed gas forming a mixture or an emulsion between the auxiliary fluid and the fuel.

8. The burner as claimed in claim 1, wherein a multiphase fluid leaving said injection means has an average speed between 40 and 100 m/s.

9. The use of the burner as claimed in claim 1 for industrial application, particularly for powers comprising between 3 and 75 MW per burner.

10. The burner as claimed in claim 1, wherein said flame stabilizer has a cylindrical outer wall and a cylindrical inner wall, the rose being located between said walls and the hub being attached the inner cylindrical wall.

* * * * *